US009330862B2

(12) United States Patent
Hsu et al.

(10) Patent No.: US 9,330,862 B2
(45) Date of Patent: May 3, 2016

(54) KEYBOARD DEVICE

(71) Applicant: Wistron Corporation, New Taipei (TW)

(72) Inventors: Wen-Chi Hsu, New Taipei (TW); Cheng-Wen Shen, New Taipei (TW)

(73) Assignee: Wistron Corporation, Hsichih, New Taipei (TW)

( * ) Notice: Subject to any disclaimer, the term of this patent is extended or adjusted under 35 U.S.C. 154(b) by 224 days.

(21) Appl. No.: 14/019,494

(22) Filed: Sep. 5, 2013

(65) Prior Publication Data

US 2014/0374231 A1 Dec. 25, 2014

(30) Foreign Application Priority Data

Jun. 21, 2013 (TW) ..... 102122222 A

(51) Int. Cl.
*H01H 1/10* (2006.01)
*H01H 13/14* (2006.01)
(Continued)

(52) U.S. Cl.
CPC ..... *H01H 13/14* (2013.01); *H01H 13/704* (2013.01); *H01H 13/705* (2013.01); *H01H 2215/00* (2013.01); *H01H 2217/024* (2013.01); *H01H 2221/08* (2013.01)

(58) Field of Classification Search
CPC ..... H01H 9/26; H01H 13/72; H01H 13/76; H01H 36/00; H01H 36/004; H01H 36/008; H01H 2201/00; H01H 2201/018; H01H 2219/036; H01H 2219/037; H01H 2215/05; H01H 2215/044; H01H 2221/04; H01H 2221/046; H01H 2221/048
USPC ..... 200/510–517, 341–345, 5 A, 520, 302.2, 200/308; 400/490; 264/257, 274; 425/127
See application file for complete search history.

(56) References Cited

U.S. PATENT DOCUMENTS 3,908,100 A * 9/1975 Richard et al. ..... 200/5 A
4,454,562 A * 6/1984 Bush et al. ..... 361/288
(Continued)

FOREIGN PATENT DOCUMENTS

CN 101930866 A 12/2010
TW 364132 7/1999
(Continued)

OTHER PUBLICATIONS

Office action mailed on Feb. 25, 2015 for the Taiwan application No. 102122222, filing date: Jun. 21, 2013, p. 2 line 6-26, p. 3-5 and p. 6 line 1-8.
(Continued)

*Primary Examiner* — Renee Luebke
*Assistant Examiner* — Anthony R. Jimenez
(74) *Attorney, Agent, or Firm* — Winston Hsu; Scott Margo

(57) ABSTRACT

The present invention discloses a keyboard device. The keyboard device includes a sheet, a membrane switch, an actuating component, and a protrusion keycap structure. The membrane switch is disposed on a side of the sheet. The actuating component is disposed on a side of the membrane switch far away from the sheet and is for pressing the membrane switch to actuate the membrane switch. The protrusion keycap structure is disposed on a side of the actuating component far away from the membrane switch and is for driving the actuating component to actuate the membrane switch upon being pressed. The protrusion keycap structure includes a mylar film.

11 Claims, 4 Drawing Sheets

(51) Int. Cl.
*H01H 13/704* (2006.01)
*H01H 13/705* (2006.01)

(56) References Cited

U.S. PATENT DOCUMENTS

| | | | | |
|---|---|---|---|---|
| 5,399,821 | A * | 3/1995 | Inagaki et al. | 200/341 |
| 5,557,079 | A * | 9/1996 | Jackson et al. | 200/5 A |
| 5,881,866 | A | 3/1999 | Miyajima | |
| 6,835,906 | B2 * | 12/2004 | Okamoto et al. | 200/341 |
| 7,947,915 | B2 * | 5/2011 | Lee et al. | 200/314 |
| 8,207,872 | B2 | 6/2012 | Huang | |
| 8,581,127 | B2 | 11/2013 | Jhuang | |
| 2010/0078301 | A1 * | 4/2010 | Yeh | H01H 13/705 200/344 |
| 2012/0080300 | A1 | 4/2012 | Chen | |

FOREIGN PATENT DOCUMENTS

| | | |
|---|---|---|
| TW | I269332 | 12/2006 |
| TW | 201029032 | 8/2010 |
| TW | 201136489 | 10/2011 |
| TW | 201216310 | 4/2012 |
| TW | 201250745 | 12/2012 |
| TW | 201318017 | 5/2013 |

OTHER PUBLICATIONS

Office action mailed on Nov. 3, 2015 for the China application No. 201310286797.1, p. 3 line 4-28, p. 4-9 and p. 10 line 1-2.

* cited by examiner

KEYBOARD DEVICE

BACKGROUND OF THE INVENTION

1. Field of the Invention

The present invention relates to a keyboard device, and more especially, to a keyboard device with a slim structure and good operation feeling.

2. Description of the Prior Art

A keyboard device is one of the indispensable input devices, which is applied for a notebook computer for inputting characters, symbols or numerals. The notebook computer has the trend toward compactness, slimness, and lightness, so that the keyboard of the notebook computer is required to be slimmer. An evaluating mechanism, such as a rubber dome or a scissor structure, is disposed between a sheet and a keycap of the conventional keyboard and is for recovering the keycap after being pressed and then released. However, there is a reserved height of a thickness of the conventional keycap and the evaluating mechanism (such as the rubber dome or the scissor structure). It is necessary to reserve more mechanical space for the increased height of the keyboard device, resulting in constraint on an appearance and a dimension of the notebook computer and the development of a slim type notebook computer. In addition, it is necessary to reserve a gap for the conventional keycap with the rubber dome or the scissor structure for preventing the evaluating keycap being stuck, so that external dust or water might easily get into the keyboard device and it significantly affects dustproof and waterproof functions.

SUMMARY OF THE INVENTION

The present invention is to provide a keyboard device with a slim structure and good operation feeling for solving the above drawbacks.

According to the disclosure, a keyboard device includes a sheet, a membrane switch, an actuating component and a protrusion keycap structure. The membrane switch is disposed on a side of the sheet. The actuating component is disposed on a side of the membrane switch far away from the sheet and for pressing the membrane switch to actuate the membrane switch. The protrusion keycap structure is disposed on a side of the actuating component far away from the membrane switch and for driving the actuating component to actuate the membrane switch upon being pressed. The protrusion keycap structure includes a mylar film.

According to the disclosure, the mylar film includes a flat portion and a protruding portion connected to the flat portion, and the keyboard device further includes a first cushion component disposed in a containing space formed between the protruding portion and the actuating component.

According to the disclosure, the first cushion component is made of sponge, rubber or plastic material.

According to the disclosure, the keyboard device further includes a second cushion component disposed between the sheet and the membrane switch.

According to the disclosure, the second cushion component is made of sponge, rubber or plastic material.

According to the disclosure, the flat portion and the protruding portion are formed by an in-mold film process.

According to the disclosure, the first cushion component is glued to the actuating component.

According to the disclosure, the mylar film is a flat structure, and the protrusion keycap structure further includes a transparent flexible component disposed on a side of the mylar film far away from the actuating component. The transparent flexible component includes a flexible flat portion and a flexible protruding portion connected to the flexible flat portion.

According to the disclosure, the flexible flat portion of the transparent flexible component be adhered to the mylar film.

According to the disclosure, the keyboard device includes a cushion component disposed between the mylar film and the actuating component.

According to the disclosure, the cushion component is made of sponge, rubber or plastic material.

According to the disclosure, the keyboard device further includes a cushion component disposed between the sheet and the membrane switch.

According to the disclosure, the cushion component is made of sponge, rubber or plastic material.

According to the disclosure, the transparent flexible component is made of transparent rubber material.

According to the disclosure, a character pattern is formed on the mylar film.

According to the disclosure, the sheet is made of metal material with enhanced structural strength.

According to the disclosure, the membrane switch is a metal dome switch.

According to the disclosure, the actuating component is made of rubber material.

The present invention is to provide the keyboard device with a slim structure and good operation feeling. The keyboard device includes the protrusion keycap structure with the mylar film in replace of a conventional keycap structure so as to achieve a seamless structure of the keyboard device and prevent external dust or water from getting into the keyboard device for significantly enhancing dustproof and waterproof functions. In addition, it is effective in reducing the height of a product by utilizing the membrane switch or the touch pad in the keyboard device in replace of the conventional elevating mechanism, such as a rubber dome or a scissor structure, for conforming to the development of a slim type notebook computer.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
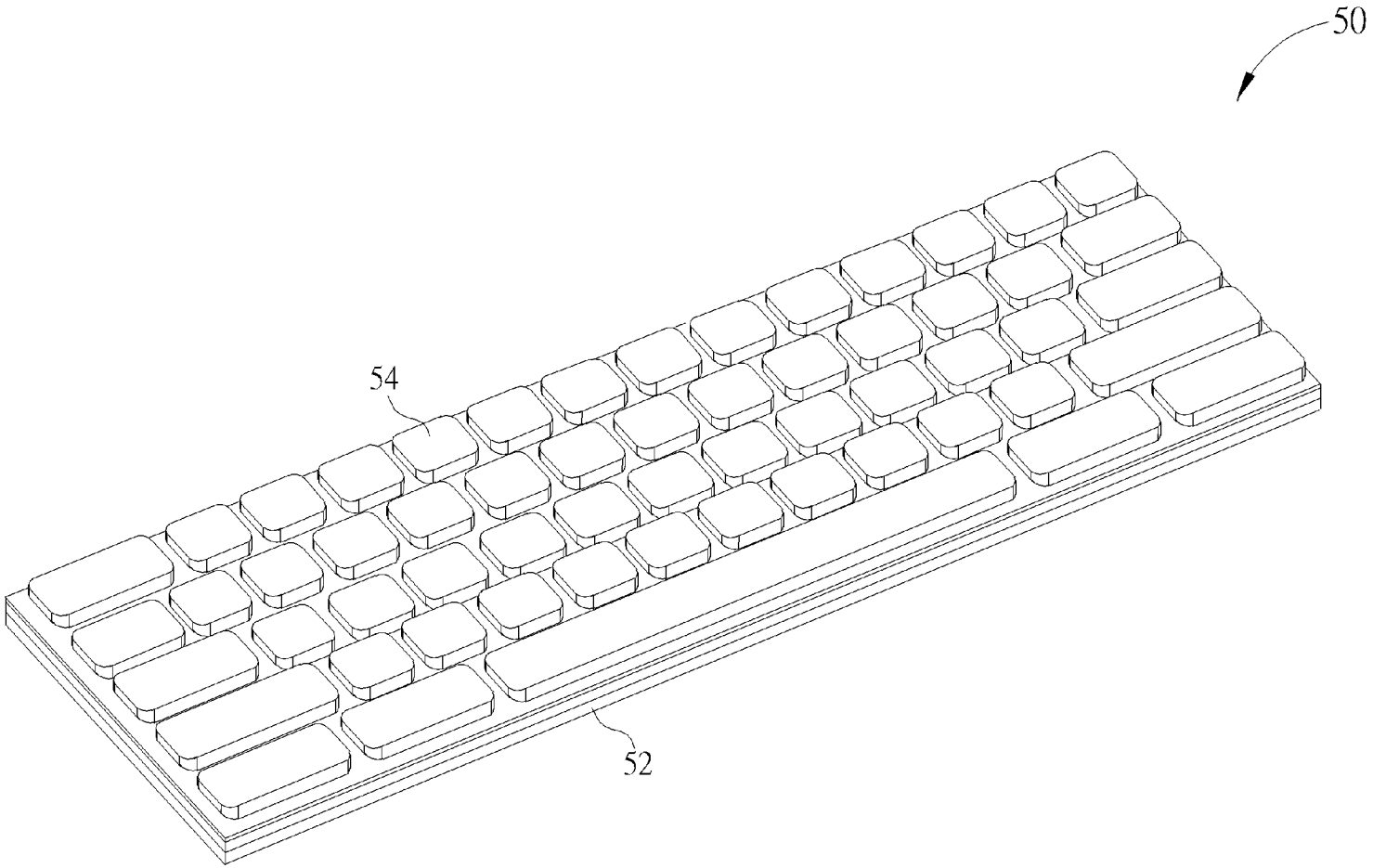
FIG. 1 is a diagram of a keyboard device according to an embodiment of the present invention.

Please refer to FIG. 1. FIG. 1 is a diagram of a keyboard device 50 according to an embodiment of the present invention. The keyboard device 50 includes a sheet 52 and a plurality of protrusion keycap structures 54. Each keycap structure 54 is disposed on the sheet 52, and the sheet 52 can be made of metal material with enhanced structural strength. According to the embodiment, the keyboard device 50 can be a keyboard module of a notebook computer, but it is not limited to this. For example, the keyboard device 50 can be a peripheral keyboard connected to an electronic device, such as a tablet computer, a television remote controller, a desktop computer and etc. As for which one of the above-mentioned designs is adopted, it depends on practical demands.

Figure 2:
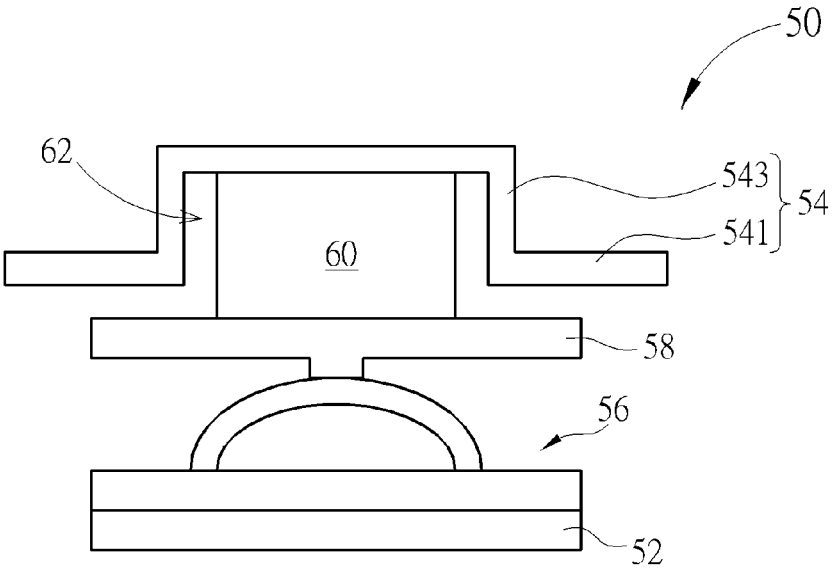
FIG. 2 is a partial cross-section diagram of the keyboard device according to a first embodiment of the present invention.

Please refer to FIG. 2. FIG. 2 is a partial cross-section diagram of the keyboard device 50 according to a first embodiment of the present invention. An operation of a single protrusion keycap structure 54 is introduced as follows, and other protrusion keycap structures 54 have the same operation. The keyboard device 50 includes a membrane switch 56, an actuating component 58 and a first cushion component 60. The membrane switch 56 is disposed on a side of the sheet 52, and the membrane switch 56 can be a metal dome switch. The actuating component 58 is disposed on a side of the membrane switch 56 far away from the sheet 52 and for pressing the membrane switch 56 so as to actuate the membrane switch 56. The actuating component 58 can be made of rubber material. The protrusion keycap structure 54 is disposed on a side of the actuating component 58 far away from the membrane switch 56 and for driving the actuating component 58 to actuate the membrane switch 56 upon being pressed. According to this embodiment, the protrusion keycap structure 54 can be a mylar film. The mylar film includes a flat portion 541 and a protruding portion 543 connected to the flat portion 541. The flat portion 541 and the protruding portion 543 can be formed by an in-mold film process so that the protrusion keycap structure 54 can be formed in a three-dimensional structure. In addition, a character pattern can be formed on the mylar film for presenting the corresponding character of the keycap. Besides, a raised point also can be formed on the mylar film for helping a blind in typing.

In addition, the first cushion component 60 is disposed in a containing space 62 formed between the protruding portion 543 and the actuating component 58. The first cushion component 60 can be glued to the actuating component 58, but not limited to this. The cushion component 60 can be made of sponge, rubber or plastic material so as to improve the operation feeling as pressing the protrusion keycap structure 54.

When a user presses the protruding portion 543 of the protrusion keycap structure 54, a downward force is applied to the first cushion component 60 by the protrusion keycap structure 54, and the actuating component 58 corresponding to the first cushion component 60 is pressed to actuate the membrane switch 56 correspondingly. The membrane switch 56 is deformed under the pressure so as to conduct the circuit between two sides and a central portion for outputting a corresponding character signal. According to the embodiment, besides of disposing the first cushion component 60 between the protruding portion 543 and the actuating portion 58, a movement of the membrane switch 56 can be increased up to 0.4 mm for improving the typing feeling. It is helpful to distinguish the position of the keycap from adjacent ones when quickly touch typing by applying the mylar film with the three-dimensional structure, so as to improve the drawbacks in using a flat mylar film.

Figure 3:
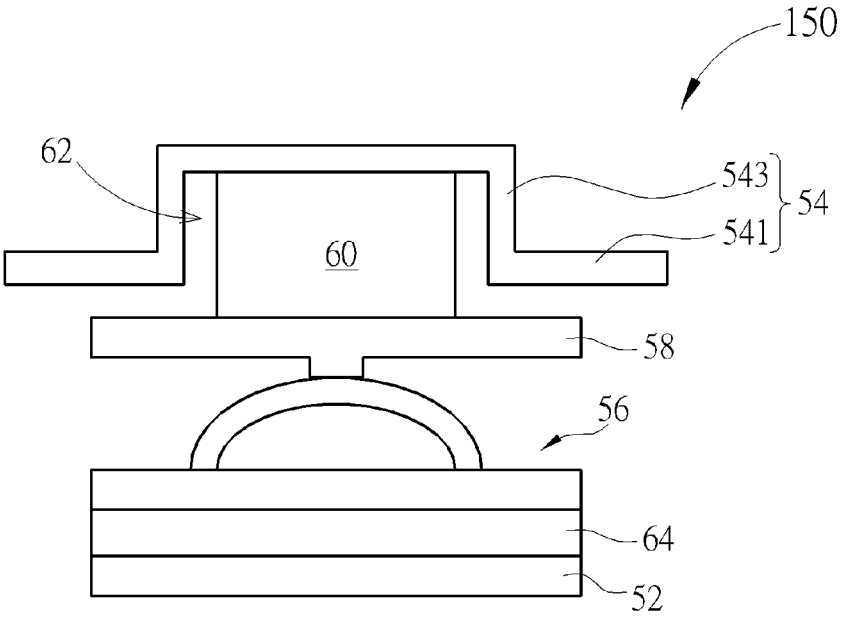
FIG. 3 is a partial cross-section diagram of a keyboard device according to a second embodiment of the present invention.

Please refer to FIG. 3. FIG. 3 is a partial cross-section diagram of a keyboard device 150 according to a second embodiment of the present invention. A difference between the first embodiment and the second embodiment is that the keyboard device 150 includes a second cushion component 62 disposed between the sheet 52 and the membrane switch 56 according to the second embodiment. The second cushion component 64 can be made of sponge, rubber or plastic material so as to improve the operation feeling when pressing down the protrusion keycap structure 54. The other working principle of the second embodiment is the same as the working principle of the first embodiment so that the detailed description is not reiterated.

Figure 4:
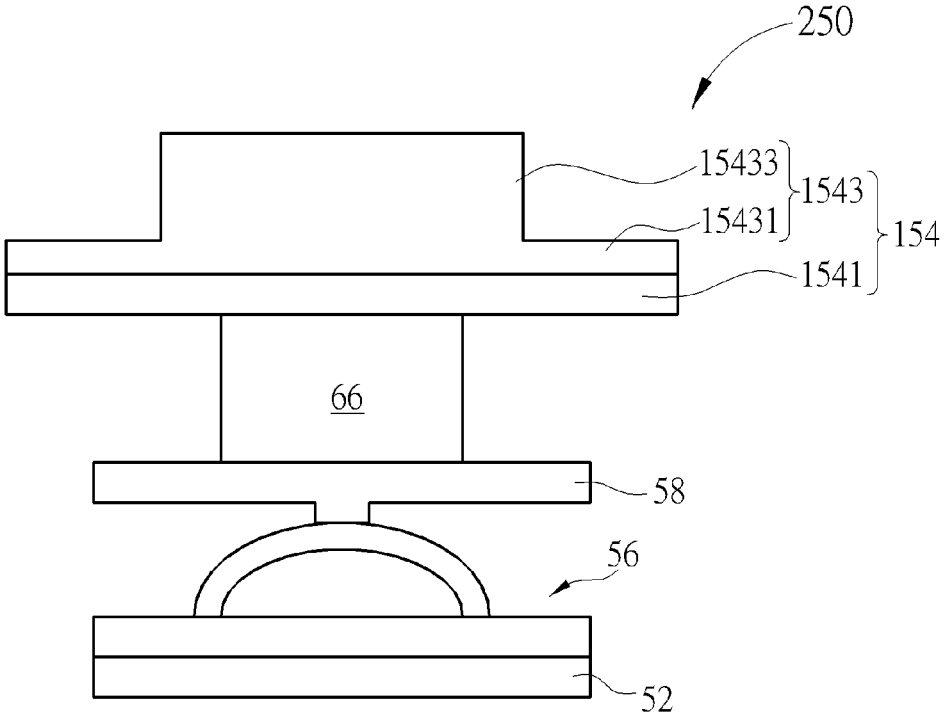
FIG. 4 is a partial cross-section diagram of a keyboard device according to a third embodiment of the present invention.

Please refer to FIG. 4. FIG. 4 is a partial cross-section diagram of a keyboard device 250 according to a third embodiment of the present invention. The keyboard device 250 includes the sheet 52, the membrane switch 56 and the actuating component 58, and further includes a protrusion keycap structure 154 and a cushion component 66. The membrane switch 56 is disposed on a side of the sheet 52, and the membrane switch 56 can be a metal dome switch. The actuating component 58 is disposed on a side of the membrane switch 56 far away from the sheet 52 and for pressing the membrane switch 56 to actuate the membrane switch 56. The actuating component 58 can be made of rubber material. The protrusion keycap structure 54 is disposed on a side of the actuating component 58 far away from the membrane switch 56 and for driving the actuating component 58 to actuate the membrane switch 56 upon being pressed. According to this embodiment, the protrusion keycap structure 154 includes a mylar film 1541 and a transparent flexible component 1543, and the transparent flexible component 1543 can be adhered to the mylar film 1541. The mylar film 1541 can be a flat structure, and a character pattern can be formed on the mylar film 1541 for presenting the corresponding character of the keycap. The transparent flexible component 1543 is disposed on a side of the mylar film 1541 far away from the actuating component 58. The transparent flexible component 1543 includes a flexible flat portion 15431 and a flexible protruding portion 15433 connected to the flexible flat portion 15431. The flexible flat portion 15431 can be adhered to the mylar film 1541, and the transparent flexible component 1543 can be made of transparent rubber material. The protrusion keycap structure 154 with a three-dimensional structure is formed by combining the mylar film 1541 and the transparent flexible component 1543. In addition, the cushion component 66 is disposed between the mylar film 1541 and the actuating component 58, and the cushion component 66 can be made of sponge, rubber or plastic material so as to improve the operation feeling as pressing the protrusion keycap structure 54.

When a user presses the protruding portion 15433 of the transparent flexible component 1543 of the protrusion keycap structure 154, a downward force is applied to the cushion component 66, and the actuating component 58 corresponding to the cushion component 60 is pressed to actuate the membrane switch 56 correspondingly. The membrane switch 56 is deformed under the pressure so as to conduct the circuit between the two sides and the central portion for outputting a corresponding character signal. According to the embodiment, besides of disposing the cushion component 66 between the protruding portion 1543 and the actuating portion 58, the movement of the membrane switch 56 can be increased up to 0.4 mm for improving the typing feeling. It is helpful to distinguish the position of the keycap from adjacent ones when quickly touch typing by applying combination of the mylar film 1541 and the transparent flexible component 1543 with the three-dimensional structure, so as to improve the drawbacks in using a flat mylar film.

Figure 5:
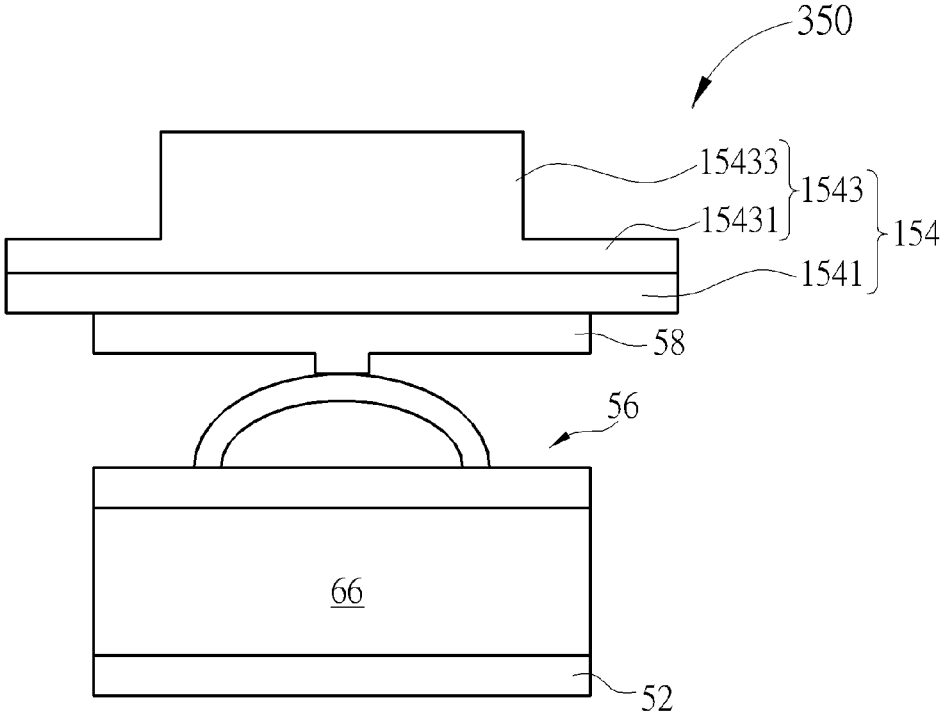
FIG. 5 is a partial cross-section diagram of a keyboard device according to a fourth embodiment of the present invention.

Please refer to FIG. 5. FIG. 5 is a partial cross-section diagram of a keyboard device 350 according to a fourth embodiment of the present invention. A difference between the fourth embodiment and the third embodiment is that the cushion component 66 is disposed between the sheet 52 and the membrane switch 56 according to the fourth embodiment. The cushion component 66 can be made of sponge, rubber or plastic material so as to improve the operation feeling when pressing down the protrusion keycap structure 154. In addition, the cushion components 66 can be disposed between the mylar film 1541 and the actuating component 58, and between sheet 52 and the membrane switch 56 at the same time. The other working principle of the fourth embodiment is the same as the working principle of the third embodiment so that the detailed description is not reiterated.

Figure 6:
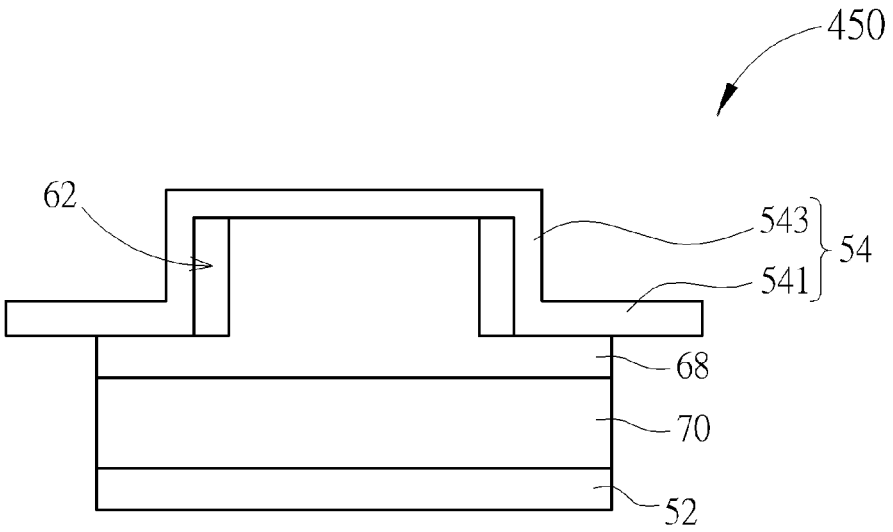
FIG. 6 is a partial cross-section diagram of a keyboard device according to a fifth embodiment of the present invention.

Please refer to FIG. 6. FIG. 6 is a partial cross-section diagram of a keyboard device 450 according to a fifth embodiment of the present invention. According to the fifth embodiment, the keyboard device 450 includes the protrusion keycap structure 54, and the protrusion keycap structure 54 can be a mylar film. The mylar film includes the flat portion 541 and the protruding portion 543 connected to the flat portion 541. The flat portion 541 and the protruding portion 543 can be formed by an in-mold film process so that the protrusion keycap structure 54 can be formed in a three-dimensional structure. The protrusion keycap structure 54 further includes a cushion component 68 and a touch pad 70, a side of the cushion component 68 is engaged with the containing space 62 of the protruding portion 543, and the touch pad 70 is disposed between the cushion component 68 and the sheet 52. It means that the touch pad 70 in this embodiment is substituted for the membrane switch 56 in the above-mentioned embodiments. When a user presses the protruding portion 543 of the protrusion keycap structure 54, a downward force is applied to the cushion component 68 by the protrusion keycap structure 54 so as to actuate the touch pad 70 in a corresponding position for outputting a corresponding character signal. According to this embodiment, the typing feeling can be improved by the cushion component 68, and it is helpful to distinguish the position of the keycap from adjacent ones when quickly touch typing by applying the mylar film with the three-dimensional structure, so as to improve the drawbacks in using a flat mylar film.

Figure 7:
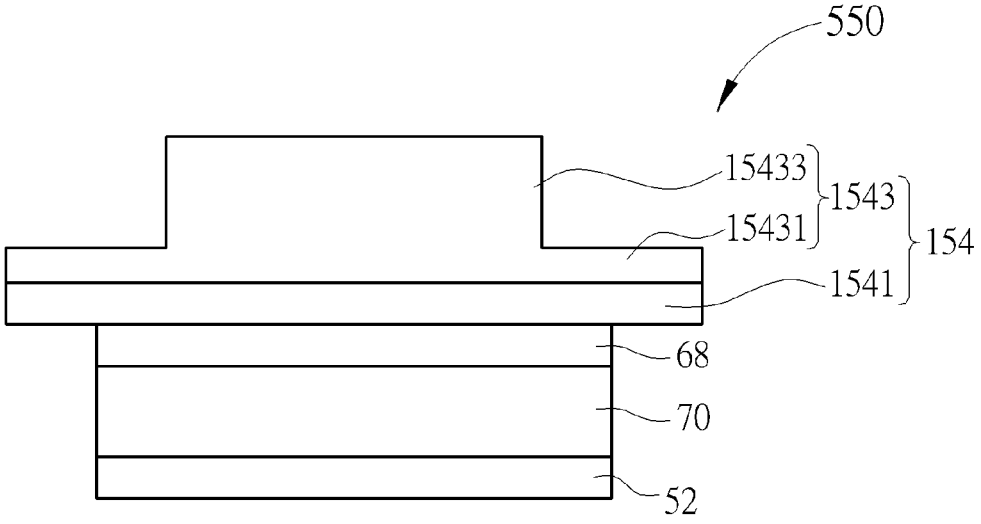
FIG. 7 is a partial cross-section diagram of a keyboard device according to a sixth embodiment of the present invention.

Please refer to FIG. 7. FIG. 7 is a partial cross-section diagram of a keyboard device 550 according to a sixth embodiment of the present invention. According to the sixth embodiment, the keyboard device 550 includes the protrusion keycap structure 154 including the mylar film 1541 and the transparent flexible component 1543, and the transparent flexible component 1543 be adhered to the mylar film 1541. The mylar film 1541 can be a flat structure, and a character pattern can be formed on the mylar film 1541 for presenting the corresponding character of the keycap. The transparent flexible component 1543 includes the flexible flat portion 15431 and the flexible protruding portion 15433 connected to the flexible flat portion 15431. The flexible flat portion 15431 be adhered to the mylar film 1541, and the transparent flexible component 1543 can be made of transparent rubber material. The protrusion keycap structure 154 with a three-dimensional structure is formed by combining the mylar film 1541 and the transparent flexible component 1543. The keyboard device 550 further includes the cushion component 68 and the touch pad 70. The cushion component 68 is disposed on a side of the mylar film 1541, and the touch pad 70 is disposed between the cushion component 68 and the sheet 52.

When a user presses the protruding portion 15433 of the transparent flexible component 1543 of the protrusion keycap structure 154, a downward force is applied to the cushion component 68 by the protrusion keycap structure 154 so as to actuate the touch pad 70 in a corresponding position for outputting a corresponding character signal. According to this embodiment, the typing feeling can be improved by the cushion component 68, and it is helpful to distinguish the position of the keycap from adjacent ones when quickly touch typing by applying the combination of the mylar film 1541 and the transparent flexible component 1543 with the three-dimensional structure, so as to improve the drawbacks in using a flat mylar film.

In contrast to the prior art, the present invention is to provide the keyboard device with a slim structure and good operation feeling. The keyboard device includes the protrusion keycap structure with the mylar film in replace of a conventional keycap structure so as to achieve a seamless structure of the keyboard device and prevent external dust or water from getting into the keyboard device for significantly enhancing dustproof and waterproof functions. In addition, it is effective in reducing the height of a product by utilizing the membrane switch or the touch pad in the keyboard device in replace of the conventional elevating mechanism, such as a rubber dome or a scissor structure, for conforming to the development of a slim type notebook computer.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A keyboard device comprising:
- a sheet;
- a membrane switch disposed on a side of the sheet;
- an actuating component disposed on a side of the membrane switch for pressing the membrane switch to actuate the membrane switch;
- a protrusion keycap structure disposed on a side of the actuating component for driving the actuating component to actuate the membrane switch upon being pressed, the protrusion keycap structure comprising:
  - a polyester film being a flat structure; and
  - a transparent flexible component disposed on a side of the polyester film, the transparent flexible component comprising a flexible flat portion and a flexible protruding portion connected to the flexible flat portion; and a cushion component disposed between the polyester film and the sheet.

2. The keyboard device of claim 1, wherein the flexible flat portion of the transparent flexible component is adhered to the polyester film.

3. The keyboard device of claim 1, further comprising the cushion component disposed between the polyester film and the actuating component.

4. The keyboard device of claim 3, wherein the cushion component is made of sponge, rubber or plastic material.

5. The keyboard device of claim 1, further comprising the cushion component disposed between the sheet and the membrane switch.

6. The keyboard device of claim 5, wherein the cushion component is made of sponge, rubber or plastic material.

7. The keyboard device of claim 1, wherein the transparent flexible component is made of transparent rubber material.

8. The keyboard device of claim 1, wherein a character pattern is formed on the polyester film.

9. The keyboard device of claim 1, wherein the sheet is made of metal material with enhanced structural strength.

10. The keyboard device of claim 1, wherein the membrane switch is a metal dome switch.

11. The keyboard device of claim 1, wherein the actuating component is made of rubber material.

* * * * *